United States Patent [19]

Gallusser

[11] Patent Number: 4,518,213

[45] Date of Patent: May 21, 1985

[54] ONE PIECE HERMAPHRODITIC CONTACT FOR AN ELECTRICAL CONNECTOR AND A METHOD OF MAKING THE CONTACT

[75] Inventor: David O. Gallusser, Oneonta, N.Y.

[73] Assignee: Allied Corporation, Morristown, N.J.

[21] Appl. No.: 499,694

[22] Filed: May 31, 1983

[51] Int. Cl.[3] ..... H01R 25/00

[52] U.S. Cl. ..... 339/48; 339/49 B; 339/256 RT

[58] Field of Search ..... 339/48, 49 B, 276 R, 339/256 RT, 252

[56] References Cited

U.S. PATENT DOCUMENTS

| | | | |
|---|---|---|---|
| 169,732 | 11/1875 | Ryder | 339/48 |
| 359,982 | 11/1887 | Plume | 339/49 B |
| 1,300,789 | 4/1919 | Tomlinson | 339/49 B |
| 1,390,607 | 9/1921 | Farmer | 339/48 |
| 2,369,860 | 2/1945 | Schroeder | 173/328 |
| 2,728,062 | 12/1955 | Klostermann | 339/255 |
| 3,221,292 | 11/1965 | Swanson | 339/217 |
| 3,286,671 | 11/1966 | Fuller | 339/252 P |
| 3,725,844 | 4/1973 | McKeown | 339/49 |
| 3,887,257 | 6/1975 | Panek | 339/45 M |
| 4,447,108 | 5/1984 | Ghigliotti et al. | 339/256 RT |

FOREIGN PATENT DOCUMENTS

| | | | |
|---|---|---|---|
| 365742 | 7/1973 | U.S.S.R. | 339/256 R |

*Primary Examiner*—Gil Weidenfeld
*Assistant Examiner*—Paula Austin
*Attorney, Agent, or Firm*—C. D. Lacina

[57] ABSTRACT

A hermaphroditic type electrical contact (20) for use within an electrical connector. The hermaphroditic contact includes an integral spring portion (15) that axially biases the forward end surface (11) of the contact when it engages the end surface (11) of another contact (20) during mating.

7 Claims, 4 Drawing Figures

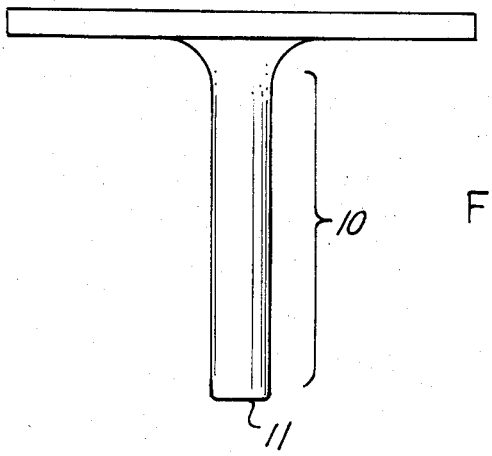
FIG. 1
FIG. 2
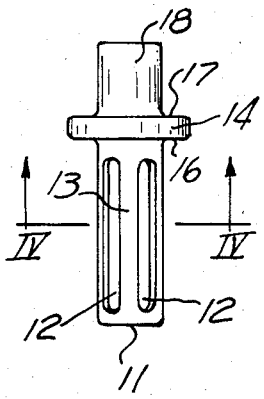
FIG. 4
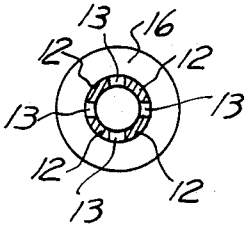
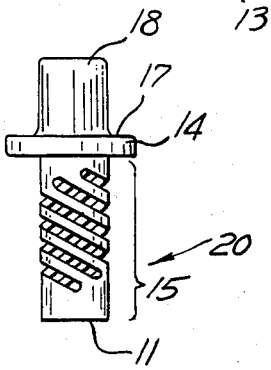
FIG. 3

ONE PIECE HERMAPHRODITIC CONTACT FOR AN ELECTRICAL CONNECTOR AND A METHOD OF MAKING THE CONTACT

This invention relates to electrical connectors and more specifically to a hermaphroditic type contact for use in such a connector.

Electrical connectors generally include a plug and receptacle each having an insert of dielectric material provided with multiple passages within which electrical contacts are retained. Most electrical connectors contain pin and socket type contacts as disclosed in U.S. Pat. No. 3,221,292 entitled "Electrical Connector" issued Nov. 30, 1965. In the pin and socket type electrical connector it is necessary to stock both pin and socket type contacts to have the capability of assembling or repairing a complete connector. To eliminate the need to stock two types of contacts, i.e., male and female, hermaphroditic type contacts have been utilized. One example of a hermaphroditic type electrical contact may be found in U.S. Pat. No. 3,725,844 entitled "Hermaphroditic Electrical Contact" issued Apr. 3, 1973. In both the male and female type and hermaphroditic type contacts it is important that good electrical continuity be established between the mated pairs of contacts. Accordingly, all of the foregoing types of contacts are designed to provide pressure between the contacting surfaces of the contacts upon mating. Accordingly, it has always been a problem in designing electrical contacts to provide and maintain pressure between the mating surfaces of contacts.

DISCLOSURE OF THE INVENTION

This invention provides a hermaphroditic electrical contact for an electrical connector that provides pressure between the contacting surfaces of a mated pair of contacts. The invention is a one piece hermaphroditic contact characterized by a spring portion that extends along the central axis of the contact and terminates in a planar surface perpendicular to the central axis. The spring portion applies an axial bias against the planar surface when it engages a similar contact upon mating.

Accordingly, it is an advantage of this invention to provide a hermaphroditic electrical contact that is axially biased after mating to maintain good electrical continuity between the mated surfaces.

DETAILED DESCRIPTION OF THE INVENTION

FIGS. 1-3 illustrate the steps in making a hermaphroditic contact incorporating the principles of this invention.

FIG. 4 is an end view of the member shown in FIG. 2.

FIG. 1 shows a tubular member 10 having a closed end surface 11 drawn from a flat blank of metal, such as beryllium copper about 0.0254 centimeters thick.

FIG. 2 illustrates slits 12 formed in a portion of the tubular member, an enlarged middle portion 14 having forwardly and rearwardly facing shoulders 16, 17, and axially extending member 13 in the forward portion.

FIG. 3 illustrates the hermaphroditic contact. The spring portion 15 of the contact is formed by twisting the axial members 13. The end surface 11 is a generally planar surface which is adapted to contact the same surface of another contact upon the mating of the contacts. The planar surface may be slightly curved in the forward direction, if desired. The shoulders 16, 17 of the enlarged portion 14 are utilized in retaining the contact in an electrical connector insert. Adjacent the rear shoulder 17 is the wire receiving portion 18 of the contact. An example of an electrical connector having the mechanism for retaining the contact may be found in U.S. Pat. No. 3,165,369 entitled "Retention System for Electrical Contacts" issued Jan. 12, 1966. Upon mating of an electrical connector assembly having contacts of the type shown in FIG. 3 the halves of the connector assembly are drawn together and the end surfaces 11 of each pair of mated contacts engage each other. As the connector halves are drawn closer together the axial force on each of the end surfaces 11 of a mated pair of contacts 20 increases as a result of the action of the spring portion 15 of each support contact.

FIG. 4 illustrates that there are preferably four axial slots 12 and four axial members 13 that will be formed into the spring portion 15 of the contact.

Having described the invention, what is claimed is:

1. A one-piece contact comprising a cylindrical forward mating portion drawn and formed from a single piece of metal, said forward mating portion including at least two elongated members helically twisted about each other along a central axis to form an axially retractible spring portion with each said member terminating at a closed forward end having a planar surface perpendicular to the central axis, each of said elongated members helically overlapping as they twist about to define the mating portion.

2. The contact as recited in claim 1 including, at the other end of said spring portion, an enlarged portion having forwardly and rearwardly facing shoulders and adjacent said rearwardly facing shoulder a wire receiving portion.

3. The contact as recited in claim 1 wherein said forward mating portion includes four elongated members arranged equiangularly.

4. The contact as recited in claim 1 wherein said forward mating portion includes a closed rearward end, each said elongated member has a forward first end and a rearward second end with each of the first and second ends being integrally connected, respectively, to said rearward end and said forward end, and the first end of each said elongated member being angularly twisted relative to its second end by an amount substantially greater than 90°.

5. The contact as recited in claim 4 wherein the first and second ends of each said elongated member are twisted approximately 360° whereby the first and second ends of each said elongated member are longitudinally disposed.

6. In combination with an electrical connector assembly of the type having a pair of mating shells with each said shell carrying a dielectric insert having a passage for retaining an electrical contact, and a contact having a central axis disposed in each of said passages, the improvement wherein each said contact comprises: a one-piece electrical contact having a rear portion, a central portion, a mating forward portion terminating in a closed surface perpendicular to said axis with the closed surface from each said contact being adapted to abut during mating, and bias means disposed between said central portion and said forward portion for biasing said forward portion axially forward and resisting axial retraction of the closed surfaces when they abut said biasing means being integral with said contact and comprising a plurality of elongated members being helically twisted about each other to form a cylindrical spring portion between the central portion and the closed surface and adjacent of the elongated members being so twisted as to spiral into an overlapped relationship with its adjacent elongated member.

7. The combination as recited in claim 6 wherein the biasing means comprises a plurality of elongated members twisted about each other to form a spring.

* * * * *